US005727753A

United States Patent [19]

Harris

[11] Patent Number: 5,727,753

[45] Date of Patent: Mar. 17, 1998

[54] WEB TENSION EQUALIZER ROLL

[75] Inventor: J. C. Harris, Dale, Ind.

[73] Assignee: The Servants, Inc., Jasper, Ind.

[21] Appl. No.: 567,297

[22] Filed: Dec. 5, 1995

[51] Int. Cl.[6] ..... B65H 23/025

[52] U.S. Cl. ..... 242/615.1; 242/615.2; 226/21; 226/191; 226/194

[58] Field of Search ..... 242/615.2, 615.1, 242/612; 226/191, 194, 21, 22, 23; 492/16

[56] References Cited

U.S. PATENT DOCUMENTS

| | | | |
|---|---|---|---|
| 597,956 | 1/1898 | Cocker . | |
| 850,892 | 4/1907 | Ball et al. . | |
| 3,055,083 | 9/1962 | Stobi . | |
| 3,224,757 | 12/1965 | Parke . | |
| 3,315,859 | 4/1967 | Owen et al. | 226/194 |
| 3,608,796 | 9/1971 | Morse et al. | 226/194 |
| 3,658,271 | 4/1972 | Austin . | |
| 3,831,876 | 8/1974 | Phelps . | |
| 4,109,976 | 8/1978 | Koch . | |
| 4,196,803 | 4/1980 | Lovett | 226/21 |
| 4,198,012 | 4/1980 | Esmonde . | |
| 4,235,002 | 11/1980 | Pav . | |
| 4,261,788 | 4/1981 | McClung | 226/194 |
| 4,461,431 | 7/1984 | Wiley et al. . | |
| 4,541,557 | 9/1985 | Fell et al. | 242/615.2 |
| 4,551,203 | 11/1985 | Eskelinen . | |
| 4,770,550 | 9/1988 | Takahashi | 242/615.2 |
| 4,809,445 | 3/1989 | Meyer . | |
| 4,815,646 | 3/1989 | Mizoguchi | 226/194 |
| 5,061,087 | 10/1991 | Roerig . | |
| 5,209,418 | 5/1993 | Alexander, III . | |
| 5,219,231 | 6/1993 | Sheedy . | |
| 5,224,790 | 7/1993 | Hein . | |
| 5,244,518 | 9/1993 | Krayenhagen et al. . | |
| 5,265,965 | 11/1993 | Harris . | |
| 5,339,534 | 8/1994 | Krayenhagen . | |
| 5,373,982 | 12/1994 | Takahashi | 226/194 |
| 5,415,611 | 5/1995 | Krayenhagen . | |
| 5,419,509 | 5/1995 | Krayenhagen | 242/419 |
| 5,452,833 | 9/1995 | Hutter | 226/194 |
| 5,506,738 | 4/1996 | Tamura et al. | 226/191 |
| 5,547,449 | 8/1996 | Krayenhagen . | |

FOREIGN PATENT DOCUMENTS

| | | | |
|---|---|---|---|
| 4425412 | 10/1969 | Japan | 242/615.2 |

*Primary Examiner*—John M. Jillions

*Attorney, Agent, or Firm*—Middleton & Reutlinger; David W. Carrithers

[57] ABSTRACT

An equalizer roll to be used in manufacturing for providing equal tension across a web during winding operations such as used in polymer film applications, corrugators, paper machines, printing presses, cloth winders, and metal winding operations.

A common axis shaft is mounted horizontally on two bearings or clamped rigid supports allowing for rotation. Mounted in the center of the axis shaft is a bearing assembly having convex and concave portions disposed within a sleeve. The bearing assembly is centrally mounted inside a hollow cylinder or roll machined to be in balance with respect to the centrally disposed bearing assembly. The mating of the concave and convex portions of the bearing permits a selected degree of lateral rotation in a range of from about 1 degree to about 10 degrees. As the web runs over the roll, any imbalance of lateral tension will cause the roll to pivot at it's center permitting the roll to move upward on the side of least tension until the web tension is equalized across the entire roll.

40 Claims, 8 Drawing Sheets

WEB TENSION EQUALIZER ROLL

BACKGROUND OF THE INVENTION

1. Technical Field

This invention relates to surface winding and unwinding of cloth, paper, metal, or plastic webs and the like from web rolls. The present invention utilizes an equalizer roll to be used in manufacturing for providing equal tension across a web during winding operations such as used in polymer film processing applications, corrugators, paper machines, printing presses, cloth winders, and metal winding operations.

2. Background Information

The present invention comprises an equalizer roll for stabilizing the run of a material web which is being rolled off of or onto a drum or through a series of rollers. The present invention is designed to provide a method of optimally stabilizing and controlling the tension of a web while the web is traveling between rolls.

One application is in the drying section of a high speed paper machine where the paper web to be dried meanders over drying cylinders. The present equalizer roll is also useable in connection with a "transfer foil", i.e., a device for transferring the paper web from the press section to the drying section such as described in U.S. Pat. No. 4,551,203. The present invention may also be utilized for stabilizing and controlling the tension of a paper web of paper coaters. It is contemplated that the present invention can also be used in the fabric industry; plastics film, sheet, and tape industry; and in the metal film and foil industry.

The equalizer roll of the present invention in the paper industry solves the problem of wrinkles being formed in the paper during processing by apparatus such as is described in U.S. Pat. No. 4,441,263. The present invention provides a means to control the pressure conditions in the area where the paper web runs together with a backing belt on a receiving drying cylinder and across the entire width of the paper web extending across the entire length of the drying cylinder. As is generally known, air flow transverse to the drying section causes the edges of the paper web to flutter and/or the formation of wrinkles in the paper web as shown in FIG. 1. This occasionally causes the paper web to break. A stable, smooth run of the paper web requires that the forces resulting from the longitudinal tension of the paper web being equal. The longitudinal tension on the paper web caused by the drying cylinder in combination with a backing belt creates a region in the paper web where the curvature is irregular as viewed across the width of the paper web. In the center, the paper web bows out more heavily than on the edges resulting in stretching and deformation of the web.

Another application for the present invention is in the cloth industry to avoid wrinkling cloth being unwound from rolls on surface winders and unwinders, batchers, cradle let-offs and the like. As set forth in U.S. Pat. No. 5,431,358, hereby incorporated by reference, in the area where the support rolls engage the cloth roll, the cloth roll is indented presenting a shorter cloth roll radius at that point than the radius in the unengaged areas of the roll resulting in the formation of a bulge or bagging down in advance of the support roll. Sometimes, the bulge or loose pucker resulting from such bagging down advances entirely about the wound roll causing wrinkling, marking and uneven tension.

U.S. Pat. Nos. 1,738,170, 3,433,429 and 4,026,487 illustrate efforts to solve the problem through compressible support roll coverings wherein an effort is made to match the compressibility of the support roll to the compressibility of the wound web roll. An inflatable support roll and other efforts to solve the problem include uniform or continuously spaced fluting on the support rolls. Such fluting may be skewed or spiralled in respect to the longitudinal axis. A roll having spaced segments is illustrated in U.S. Pat. No. 1,093,913, whereas U.S. Pat. No. 3,239,163 illustrates uniformly spaced compressible fluting having upper surface areas conforming to the curvature of the flexible roll. Attempts to match or otherwise utilize the relative compressibility of the support rolls in relation to the compressibility of the wound rolls have met with limited success. Fluted rolls having uniform circumferential spacing result in vibration or chattering and sometimes mark the wound rolls with the pattern of the fluted segments due to the limited areas of support.

The present invention provides an equalizer roll means to equalize the tension of the web as the web runs over the rolls distributing the lateral forces so that any imbalance of lateral tension will cause the roll to pivot at it's center permitting the roll to move upward on the side of least tension until the web tension is equalized across the entire roll.

SUMMARY OF THE INVENTION

The equalizer roller of the present invention is a universal mount idler roll that works off of a center pivot point and is able to swivel 360°. It is placed before or after, and in alignment with a web roll of material for maintaining a constant tension of the web or sheet of material unrolling from a web roll to prevent stretching or wrinkling of the material and facilitating off rolling of the material in a straight line so that the sheet or ribbon does not want to veer to one side.

A common axis shaft is mounted horizontally on two shaft bearings or clamped rigid to a support means allowing for rotation. Mounted in the center of the axis shaft is a center self aligning bearing assembly having an inner convex ball and an outer concave socket portion disposed within a housing sleeve. The single center bearing assembly is mounted inside a hollow cylinder or roll machined to be in balance with respect to the centrally disposed bearing assembly. The mating of the concave and convex portions of the bearing permits a selected degree of lateral rotation and allows the roll to rotate independent of the shaft. As the web runs over the roll, any imbalance of lateral tension will cause the roll to pivot at it's center permitting the roll to move upward on the side of least tension until the web tension is equalized across the entire roll.

The preferred embodiment of the present invention provides an equalizer roll for controlling web tension including a longitudinal shaft having distal ends rotatably supported by a pair of shaft bearings, a self aligning center bearing assembly having an inner ball portion fixedly connected to the weighted center of the shaft and an outer socket portion fixedly connected to the weighted center of a cylindrical roll coaxially mounted around the shaft, wherein the deflection of the roll with respect to the shaft is in the range of from about one degree to about ten degrees, and most preferably about six degrees. A compressible bearing of selected rigidity may be utilized between the roll and shaft at one or more selected positions to limit or control oscillations of the roll with respect to the shaft.

Accordingly, it is an important object of the present invention to provide a means for winding and unwinding paper, film, plastic, cloth or metal webs and avoid the problem of wrinkling, stretching, and marking of the web.

It is another object of the present invention to provide an equalizer roll to control the tension of a web to prevent the web from veering to one side.

It is another object of the present invention to provide an equalizer roll to control oscillation by use of a central pivoting means.

It is yet another object of the present invention to use a single bearing as a central pivoting means.

BRIEF DESCRIPTION OF THE DRAWINGS

A better understanding of the present invention will be had upon reference to the following description in conjunction with the accompanying drawings in which like numerals refer to like parts throughout the several views and wherein.

DESCRIPTION OF THE PREFERRED EMBODIMENTS

The equalizer roll of the present invention is manufactured from readily available materials and simple in design. The preferred embodiment is comprised of metal, more particularly stainless steel, steel, or brass; however, it is contemplated that plastic or other polymer composite materials, such as graphite fiber, nylon, or even fiberglass, could be molded and used in combination with or substituted for the steel components of the present invention.

Figure 1:
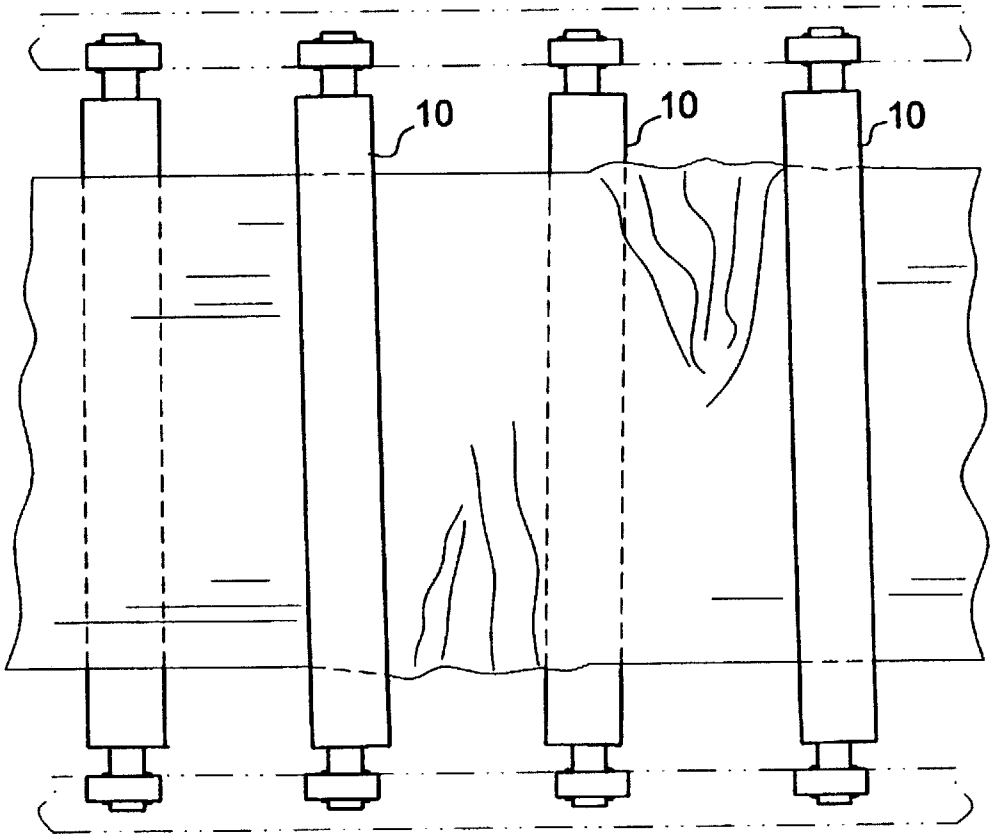
FIG. 1 is a top perspective view showing wrinkles formed in a web supported by a plurality of rollers.
Figure 2:
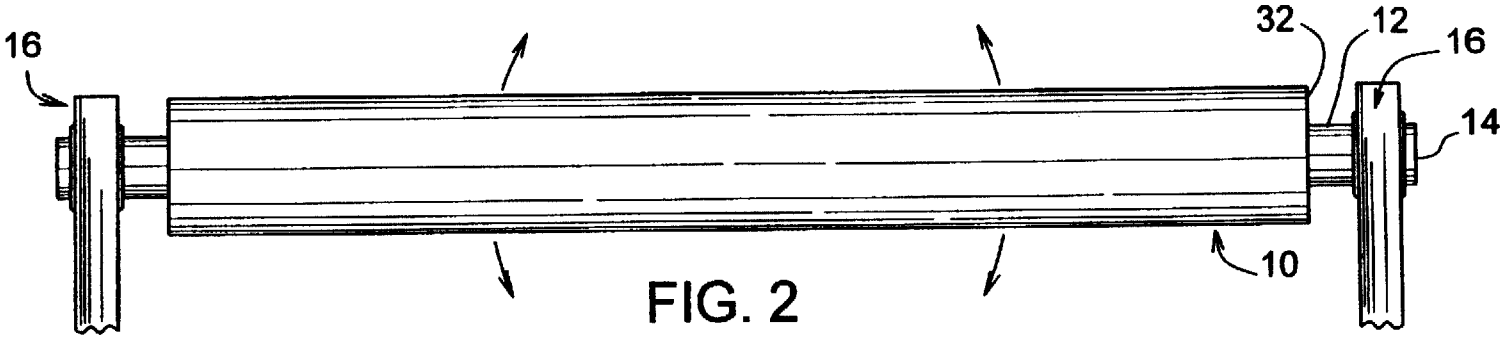
FIG. 2 is front view of the equalizer roll of the present invention showing the roll supported coaxially equal distance around a shaft supported by stationary bearings.
Figure 3:
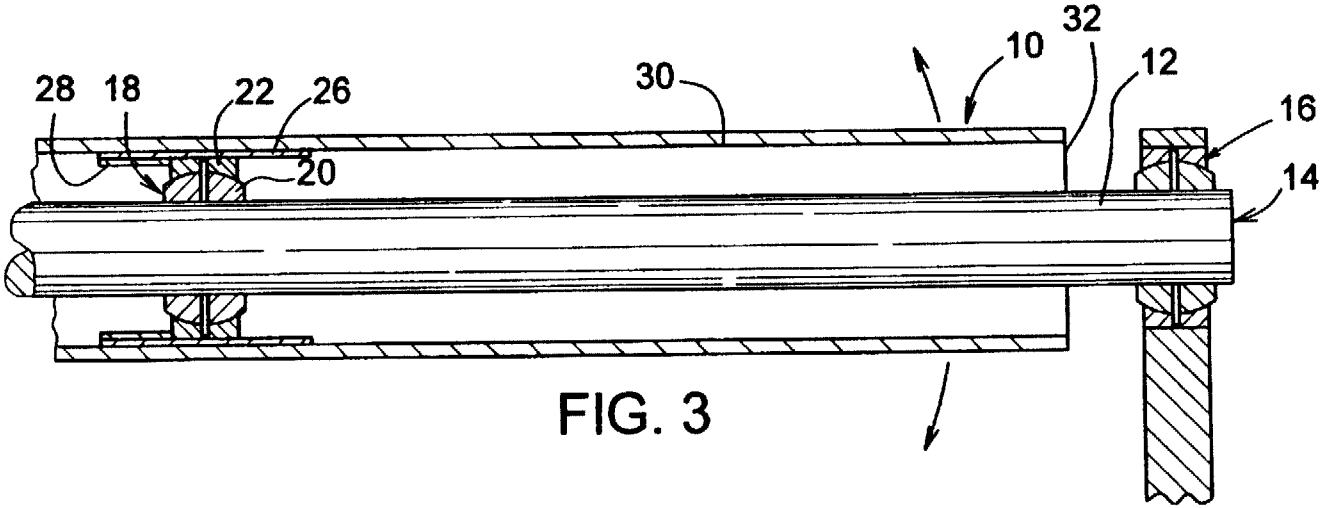
FIG. 3 is a partial cut-away view showing a central bearing assembly supporting the roll coaxially around the shaft wherein the roll is spaced equal distance from the surface of the shaft providing limited longitudinal movement of the roll around the shaft, and showing the shaft supported by a stationary end bearing.
Figure 4:
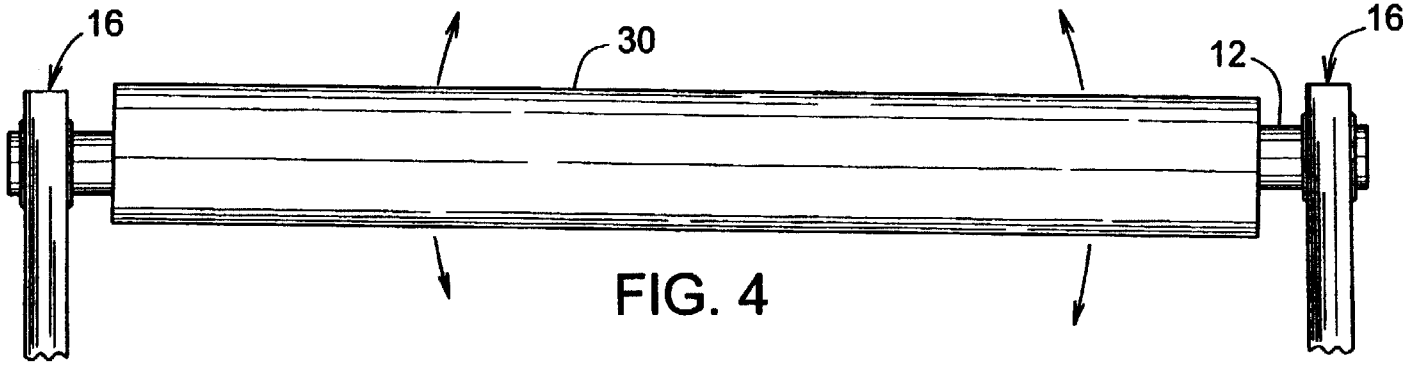
FIG. 4 is a front view showing the equalizer roll of FIG. 2, wherein application of tension to roll has caused the left end of the roll to raise upward nearer the bottom of the shaft and the right end of the roll to lower downward toward the top of the shaft.
Figure 5:
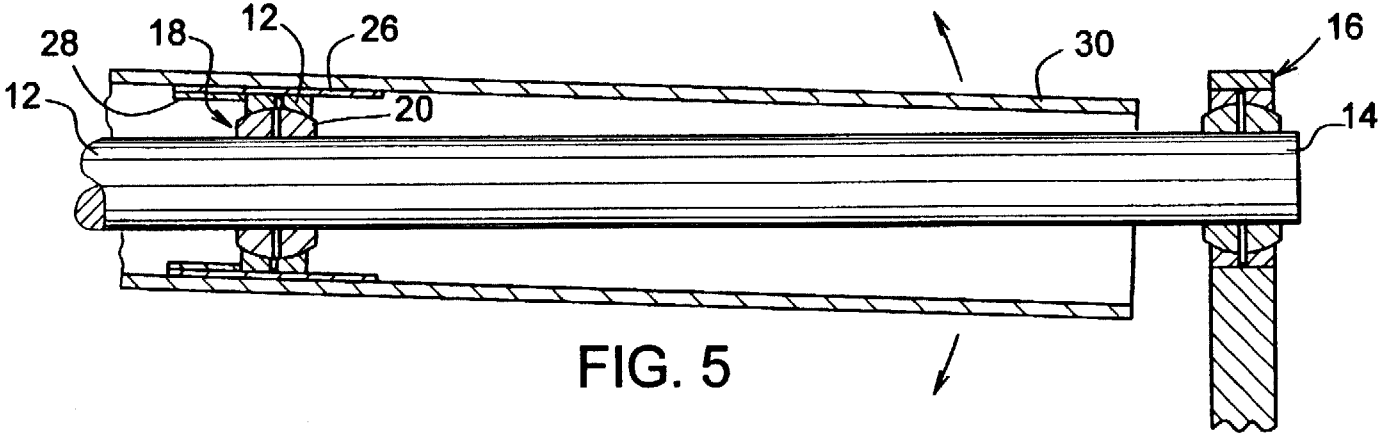
FIG. 5 is a partial cut-away view showing a central bearing assembly supporting the roll coaxially around the shaft wherein the distal ends of the roll are spaced an unequal distance from the surface of the shaft providing limited longitudinal movement of the roll around the shaft, and showing the shaft supported by a stationary end bearing.
Figure 6:
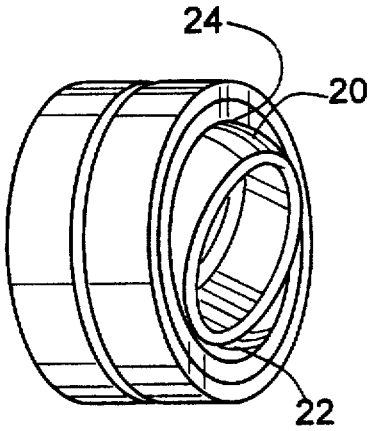
FIG. 6 shows a perspective view of the present invention showing a plain spherical roller bearing capable of pivoting upward, downward, back and forth such as is used for the center bearing assembly.
Figure 7:
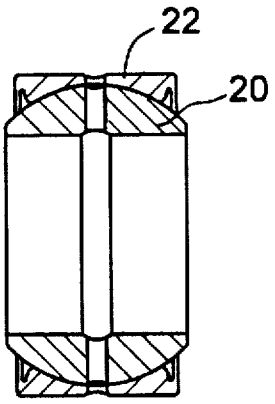
FIG. 7 is a cut-away view of the plain spherical roller bearing of FIG. 6, showing the degree of movement of the ball within the socket.
Figure 8:
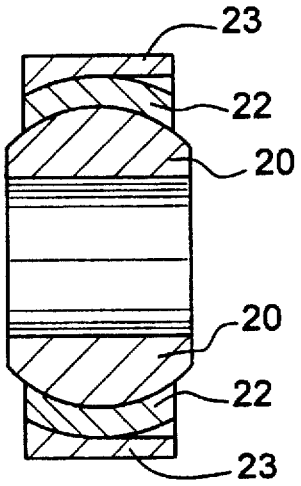
FIG. 8 is a radial cross section showing a bearing subassembly in a the mounting socket such as is used in the center bearing assembly of the present invention showing the ball, socket, and cap.
Figure 14:
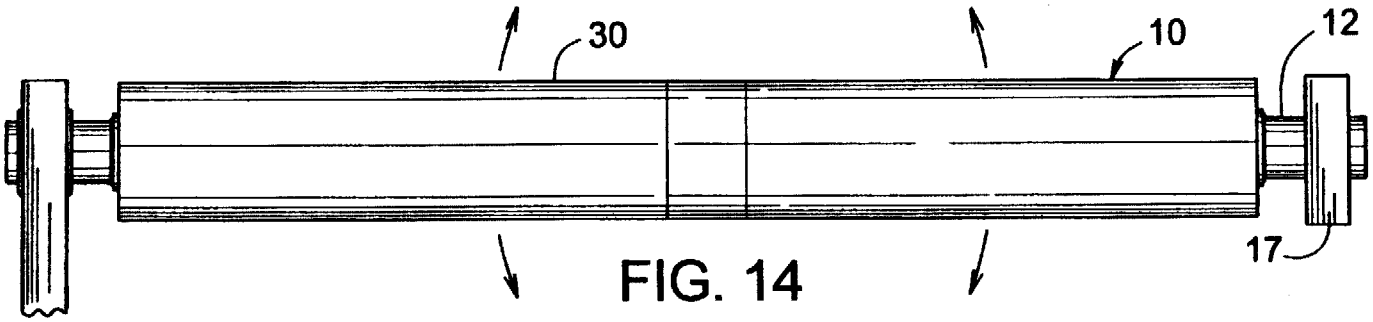
FIG. 14 is front view of the equalizer roll of FIG. 2, showing the roll supported by a shaft supported by a stationary bearing and rigid support member and showing compressible bearing assemblies inserted within the roll coaxially around the shaft.

With reference to FIGS. 2–8, the equalizer roll 10 of the present invention utilizes an axle or longitudinal shaft 12 of a selected cross-sectional area having the distal ends 14 supported by stationary shaft bearings assemblies 16 or rigid supports "fixed mount" means 17 as shown in FIG. 14. The shaft 12 is disposed through a pivotable center bearing assembly 18 comprising a spherical plain bearing such as shown in FIG. 8, a hog-ring bearing, a ball bearing, or a needle roller bearing in such a manner as to be positioned and balanced in the weighted center of the shaft 12. The center bearing 18 must provide for rotation as well as pivoting side to side oscillation and may be self aligning such as are commercially available from distributors. Spherical plain bearings are further described in U.S. Pat. No. 5,265,965, hereby incorporated by reference, which are designed for applications where both misaligning and oscillatory motions are present. These self aligning bearings such as best shown in FIGS. 6–8 typically comprise a bearing assembly 18 having a inner convex portion having a spherical outer diameter referred to as the ball 20 fixedly connected to the shaft 12. The ball 20 is rotatably and swivelly mounted within an opening or socket 22 formed in a housing or cap 23 to form a ball and socket bearing. The socket 22 comprises an outer concave inner surface or raceway 24 that is integral and remains stationary with respect to the housing. The socket 22 inner raceway 24 and the outer spherical diameter of the ball 20 must have a very closely tolerance fit to assure consistent bearing performance and long life. U.S. Pat. No. 5,265,965 discloses several other ball and socket bearings in the references cited which may be usable in the present invention.

As shown in FIGS. 3, 5, 15, and 17, a sleeve may be formed of metal such as steel or other material, such as a high durometer polymer such as teflon or graphite fiber, to form a housing or sleeve 26 immovably attached to the exterior surface of the socket 22. In the preferred embodiment a spacer 28 is inserted into one end of the sleeve adjacent the cap 23 of the center bearing 18 for positioning the center bearing assembly 18 at the balancing point defining the weighted center of the equalizer roll 10. The exterior surface of the cap 23 is held immobile in the housing sleeve 26 which is fixed connected with the inner surface of a coaxial cylindrical roll 30 allowing the cylindrical roll 30 to rotate about the axis of the shaft 12 and for the distal ends 32 of the cylindrical rolls to be deflected according to the force applied by the tension of the web. FIG. 4 shows an end view of the equalizer roll 10 assembly.

An alternative method of insertion of the center bearing assembly 18 into the roll 30 and fixedly connected to the shaft 12 is to cut the cylindrical roll 30 into two sections for insertion of the center bearing assembly 18 and then using precision welding to weld the roll back together. Upon assembly the distal ends 32 of the cylindrical roll 30 may require drilling to remove weight, or welding to add weight to obtain a perfectly balanced roll 30 wherein the inner surface of the roll 30 is equal distant from the shaft 12.

During operation the equalizer roll 10 is loaded by outer force action along a tangent such as shown in FIGS. 4 and 5. The ball 20 may be deflected off center by as much as ten degrees depending upon the application and length and diameter of the coaxial roll 30; however, the preferred embodiment provides for about a six degrees of movement for controlling the tension of the web in paper processing applications. As the web runs over the roll 30, any imbalance of lateral tension will cause the roll 30 to pivot at it's center permitting the roll 30 to move upward on the side of least tension until the web tension is equalized across the entire roll 30.

Figure 12:
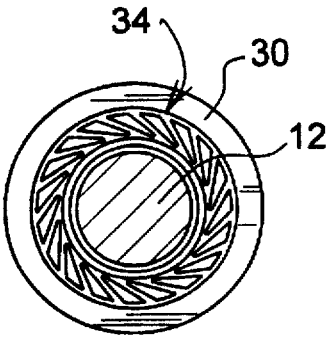
FIG. 12 is a side view of the equalizer roll of the present invention showing the compressible bushing mounted onto the shaft and the compressible bushing assembly being inserted into the roll.
Figure 13:
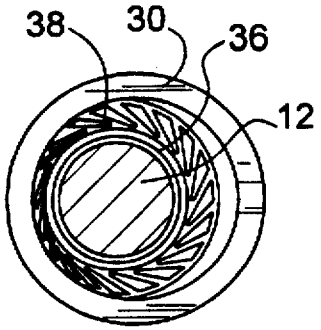
FIG. 13 is a side view of the bushing of FIG. 13, showing compression of the outer flexible bushing on one side.
Figure 11:
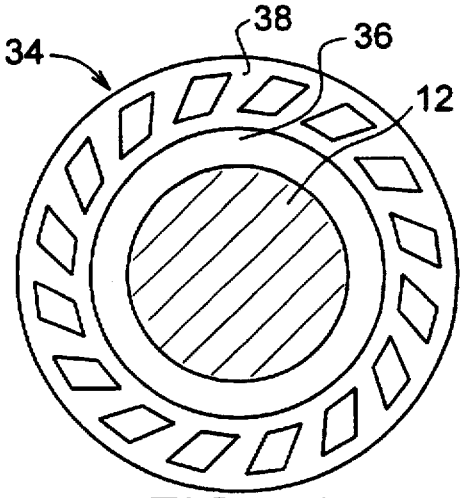
FIG. 11 is a side view showing the compressible bushing assembly of FIG. 10 mounted onto the shaft of the present invention showing unidirectional slots within the flexible outer bushing member.
Figure 18:
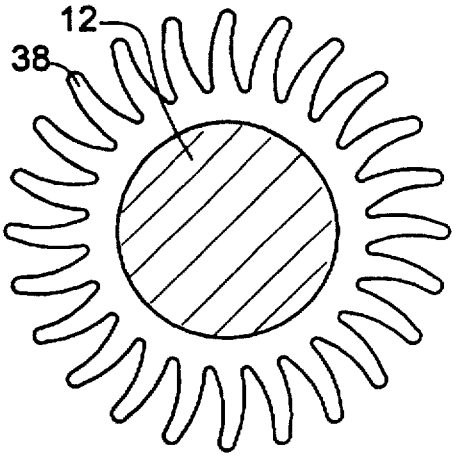
FIG. 18 is a side view showing another embodiment of a compressible bushing assembly.
Figure 10:
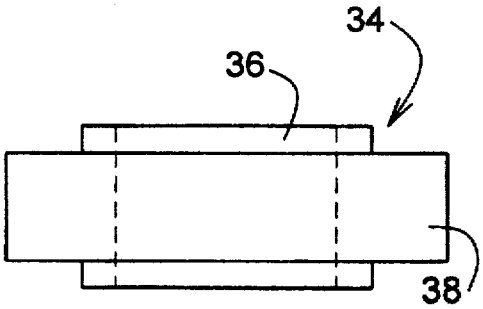
FIG. 10 is a top view showing a flexible outer bushing member mounted coaxially onto the rigid bushing of FIG. 9.
Figure 9:
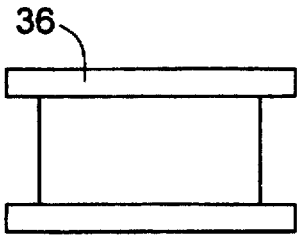
FIG. 9 is a top view showing the rigid bushing of the compressible bushing assembly which is mounted coaxially to around the shaft.
Figure 19:
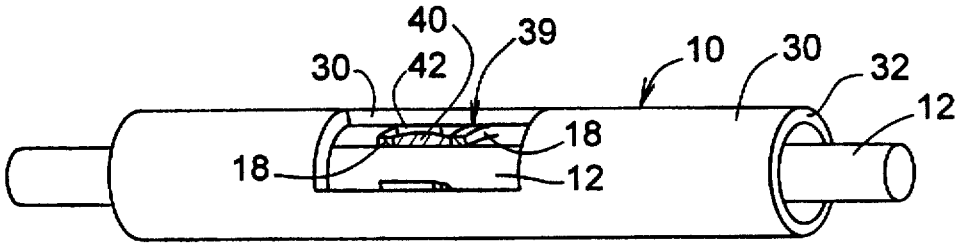
FIG. 19 is a perspective view of another embodiment of the present invention showing the roll supported by a center pivoting bearing assembly utilizing a pair of bearings spaced apart from a pivot member and being positioned coaxially around the shaft.
Figure 20:
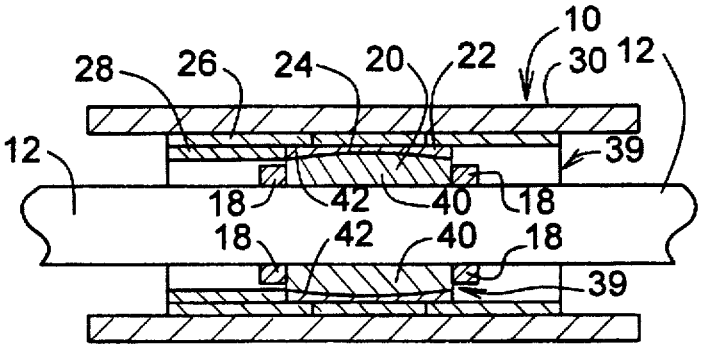
FIG. 20 is a partial cut-away view of FIG. 19 showing the roll supported by a center pivoting bearing assembly utilizing a pair of bearings spaced apart from a pivot member and being positioned coaxially around the shaft.
Figure 21:
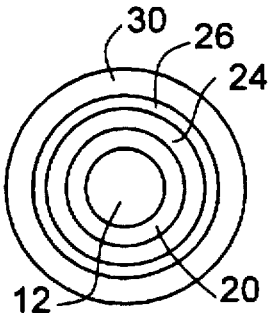
FIG. 21 is a side view of FIG. 20.

A compressible bushing assembly 34 as illustrated in FIGS. 10 and 11, consists of a generally rigid inner bushing 36 as shown in FIG. 9 which rotates coaxially around the shaft 12 together with a flexible outer bushing member 38 fixedly connected using by a friction fit with the interior surface of the roll 30. The compressible bushing 34 is inserted into selected positions within the roll 30 coaxially mounted on the shaft 12 using at or near the distal ends of the roll. The compressible bushing assemblies 34 are not necessary for all applications, but are useful when a large amount of unequal tension is produced from a particular process operation. The compressible bearing 34 provides a means for allowing the roll 30 to move and oscillate, but to still bias the roll urging it to return to the center position to align the web and control the tension thereof. The inner bushing 36 are usually fabricated from teflon, carbon graphite, nylon, metal, or other tough self lubricating plastic material; however, it is contemplated that a lubricatable bushing can be used. The composition of the material selected for the inner bushing 36 is dependent upon the heat generated by the process or retained within the web material being conveyed. As shown in FIGS. 11–12 and 19 the flexible outer bushing member 38 is generally compressed of a flexible material such as an elastomer or other polymer such as PVC, polyethylene, or urethane, and including rubber and/or silicon compounds. The selection of the composition of the flexible outer bushing member 38 is determined by the heat exposure of the compound which is often as high as 400° F. and durability. The degree of hardness desired to provide the desired cushioning is selected depending upon the web strength and the amount of "play" which is acceptable due to the oscillation of the roll 30 around the shaft 12. The preferred embodiment utilizes flexible outer bushing 38 materials having a urometer hardness in a range of about 45 to 60, and more preferably about 50. The design of the slots within the flexible bushing member 38 and or the design of the thickness, radius, and/or curvature of the irregularities or projections on the outer surface of the flexible bushing member 38 provide another means to select and control the cushioning effect of the compressible bushing assembly 34.

Figure 15:
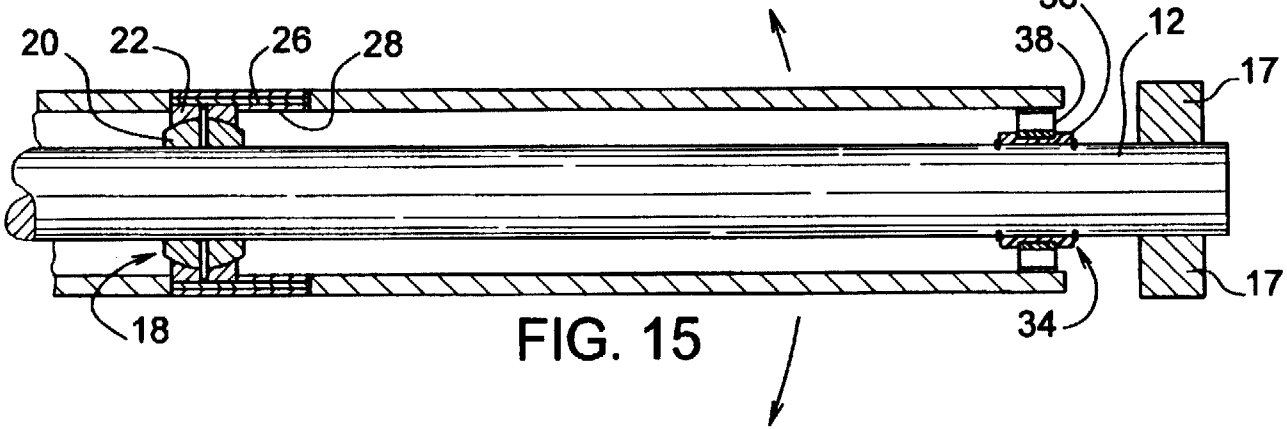
FIG. 15 is a partial cut-away view showing a central bearing assembly supporting the roll coaxially around the shaft as shown in FIG. 3, wherein the roll is spaced equal distance from the surface of the shaft providing limited longitudinal movement of the roll around the shaft, and showing the shaft supported by a stationary end bearing, and showing compressible bearing assemblies inserted within the roll coaxially around the shaft.
Figure 16:
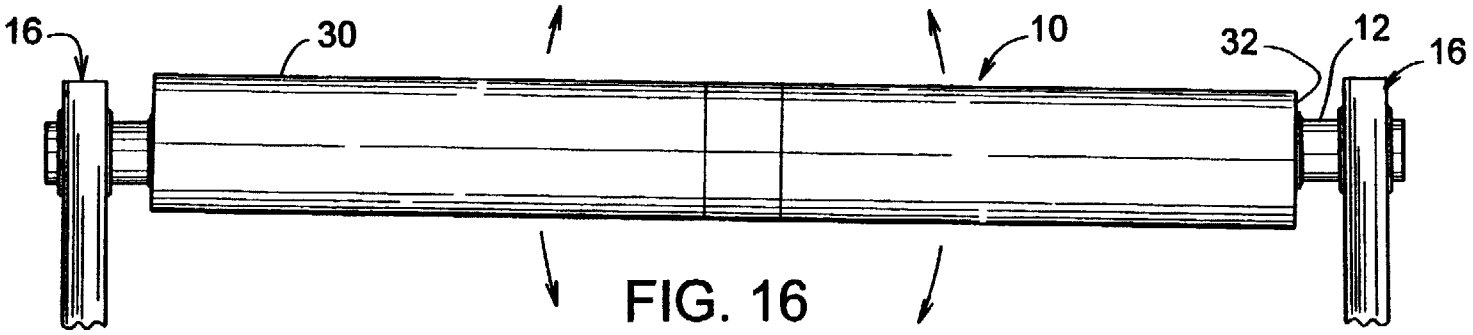
FIG. 16 is a front view showing the equalizer roll of FIG. 14, wherein application of tension to roll has caused the left end of the roll to raise upward nearer the bottom of the shaft and the right end of the roll to lower downward toward the top of the shaft and showing compression of the outer flexible bushing of the compressible bearing assemblies inserted within the roll coaxially around the shaft.
Figure 17:
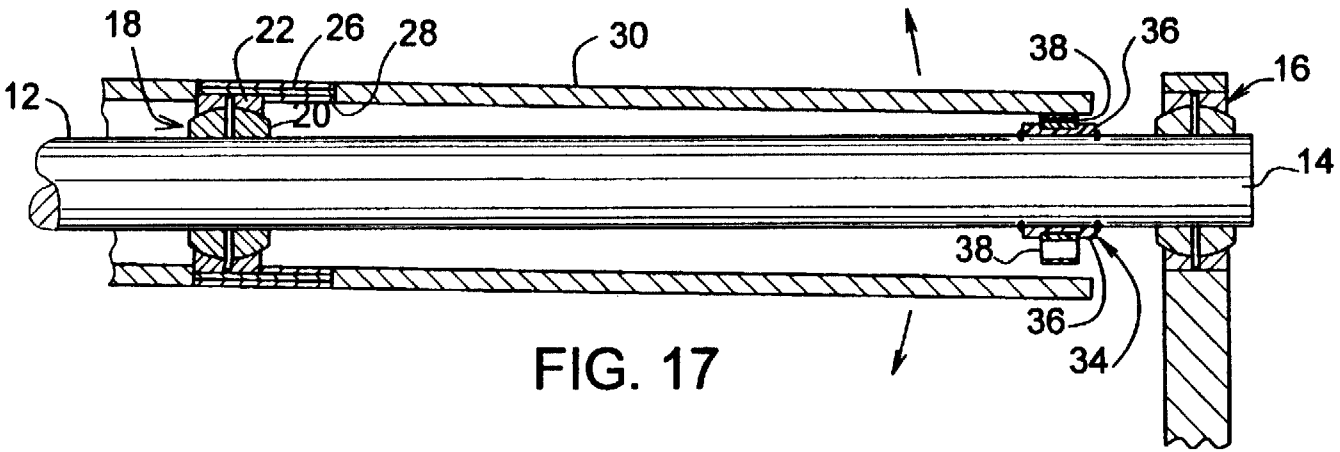
FIG. 17 is a partial cut-away view showing a central bearing assembly supporting the roll coaxially around the shaft wherein the distal ends of the roll are spaced an unequal distance from the surface of the shaft providing limited longitudinal movement of the roll around the shaft showing the shaft supported by a stationary end bearing, and showing compression of the outer flexible bushing of the compressible bearing assemblies inserted within the roll coaxially around the shaft.

FIGS. 14 and 15 shows the equalizer roll 10 supported by the shaft 12 which is supported by stationary bearings 16 and showing compressible bearing assemblies 34 inserted within the roll coaxially around the shaft. More particularly, the center bearing assembly 18 supporting the roll 30 coaxially around the shaft 12 shows the roll 30 is spaced equal distance from the surface of the shaft 12 providing limited longitudinal movement of the roll 30 around the shaft 12. The shaft 12 is supported by a pair of stationary end bearings 16. The compressible bearing assemblies 34 inserted within the roll 30 coaxially around the shaft 12 are shown in the compressed state in FIGS. 16 and 17, wherein application of tension to roll 30 has caused the left end of the roll 30 to raise upward nearer the bottom of the shaft 12 and the right end of the roll 30 to lower downward toward the top of the shaft 12 and showing compression of the outer flexible bushing 38 of the compressible bearing assemblies 34 inserted within the roll 30 coaxially around the shaft 12. As shown best in FIG. 17, a center bearing assembly 18 supporting the roll 30 coaxially around the shaft 12 has the distal ends of the roll 30 spaced an unequal distance from the surface of the shaft 12 providing limited longitudinal movement of the roll 30 around the shaft 12. The shaft 12 is shown supported by a pair of stationary end bearings 16, and the tension of the roll causes the compression of the outer flexible bushing 38 of the compressible bearing assemblies 34 inserted within the roll 30 coaxially around the shaft 12.

Figure 22:
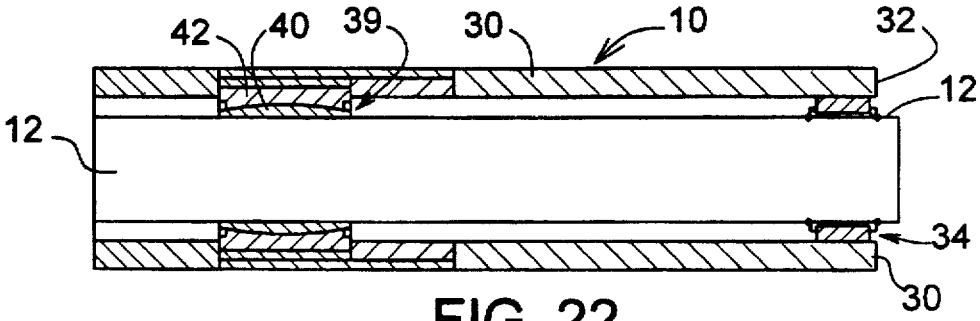
FIG. 22 is a longitudinal sectional view of FIG. 20.

As shown in FIGS. 19–22, an alternate embodiment of the present invention comprises a self-aligning pivoting bearing sleeve assembly 39 utilizes a pair of pivotally spherical bearing assemblies 18 spaced apart from one another at selected short distance whereby a convex sleeve member 40 has an inner surface fixedly attached coaxially around the shaft 12 in between the bearing assemblies 18. The convex sleeve member 40 cooperately rotatably engages a concave sleeve member 42 having an exterior surface fixedly attached to the inner surface of the roll 30, (or sleeve within the roll) providing a limited pivotable movement of the convex sleeve member 40 with the concave sleeve member 42. As shown in FIG. 22, compressible bushing assemblies 34 may also be utilized with the pivoting bearing sleeve assembly 39.

The foregoing detailed description is given primarily for clearness of understanding and no unnecessary limitations are to be understood therefrom, for modifications will become obvious to those skilled in the art based upon more recent disclosures and may be made without departing from the spirit of the invention and scope of the appended claims.

I claim:

1. An equalizer roll for controlling and correcting web tension, comprising:

a longitudinal fixed shaft having distal ends supported by a pair of support members;

a cylindrical sleeve having an inner surface defining an internal diameter greater than the external diameter of said fixed shaft, said cylindrical sleeve being spaced apart from said fixed shaft, said cylindrical sleeve supporting a web of material being conveyed over an external surface of said cylindrical sleeve between a first distal end and a second distal end;

a self aligning pivotal rotatable center bearing assembly having a single inner convex ball portion having a bore therethrough fixedly connected to said fixed shaft extending therethrough and an outer concave socket portion having an external surface fixedly connected to said inner surface of said cylindrical sleeve being positioned and balanced at a weighted center of said cylindrical sleeve being coaxially mounted around and spaced apart from said fixed shaft, said cylindrical sleeve extending outwardly past said pivotal rotatable center bearing assembly; and said cylindrical sleeve being deflectable by unequal tension of said web of material passing thereover and said fixed shaft limiting the deflection of said cylindrical sleeve and allowing for deflection and swiveling in an arc about said pivotal rotatable bearing assembly, whereby balancing of said cylindrical sleeve at the center thereof corrects deflections caused by the unequal tension in the conveyance of the web of material thereover.

2. The equalizer roll of claim 1, wherein the deflection of said cylindrical sleeve with respect to said shaft is in a range or from about 1 degree to about 15 degrees.

3. The equalizer roll of claim 1, wherein said cylindrical sleeve may be deflected with respect to said shaft in the range of from about one tenth of one degree to about 30 degrees.

4. The equalizer roll of claim 1, said equalizer roll being positioned before or after a roll having a web, ribbon, ream, sheet, or belt of material conveying therefrom in order to correct deflections and maintain a constant tension of the web of material being conveyed to prevent stretching and wrinkling, of for providing off rolling in a straight line preventing veer to one side.

5. The equalizer roll of claim 1, said cylindrical sleeve comprising material selected from the group consisting of steel, aluminum, copper, brass, teflon, graphite fiber, PVC, ABS, polyester, polyethylene, cellulose, fiberglass, and nylon.

6. The equalizer roll of claim 1, including means for removably retaining the pivotal center bearing assembly in position within said cylindrical sleeve.

7. The equalizer roll of claim 1, wherein said means for removably retaining the pivotal center bearing assembly in position within said cylindrical sleeve is a spacer.

8. The equalizer roll of claim 1, including at least one compressible bushing member having at least a portion thereof comprising a flexible material, said at least one compressible bushing member being disposed coaxially around said shaft and in cooperative communication with said inner surface of said cylindrical sleeve for absorbing shock due to deflections created by variations of the tension of the web of material passing thereover.

9. The equalizer roll of claim 8, wherein said at least one compressible bushing member is inserted between said cylindrical sleeve and said shaft near the distal end of said cylindrical sleeve.

10. The equalizer roll of claim 1, wherein said at least one compressible bushing member comprises an rotating inner bushing and a flexible fixed outer bushing member.

11. The equalizer roll of claim 10, said flexible outer bushing member cooperatively engaging said inner surface of said cylindrical sleeve by a friction fit.

12. The equalizer roll of claim 10, wherein said inner bushing is composed of material selected from the group consisting of teflon, carbon graphite, nylon, or metal.

13. The equalizer roll of claim 10, wherein said inner a bushing is composed of a seal lubricating polymer.

14. The equalizer roll of claim 13, wherein said self lubricating polymer is teflon.

15. The equalizer roll of claim 13, wherein said outer bushing member comprises a flexible material selected from the group consisting of an elastomer, PVC, polyethylene, urethane, rubber, and silicon.

16. The equalizer roll of claim 10, wherein said flexible outer bushing member can withstand a temperature as high as 400° F. (204.4° C).

17. The equalizer roll of claim 10, wherein said flexible outer bushing member has a durometer hardness in a range of from about A-45 to A-60.

18. The equalizer roll of claim 10, wherein said flexible outer bushing member includes means for controlling the resiliency formed therein.

19. The equalizer roll of claim 18, wherein said resiliency of said flexible outer bushing member is determined by the thickness, radius, and curvature thereof.

20. The equalizer roll of claim 10, wherein said resiliency of said flexible outer bushing member is determined by at least two openings formed therein.

21. An equalizer roll for controlling and correcting web tension, comprising:

a longitudinal fixed shaft having distal ends supported by a pair of support members;

a cylindrical sleeve having an inner surface defining an internal diameter greater than the external diameter of said fixed shaft, said cylindrical sleeve being spaced apart from said fixed shaft, said cylindrical sleeve supporting a web of material being conveyed over an external surface of said cylindrical sleeve between a first distal end and a second distal end;

a self aligning pivotal rotatable center bearing assembly having a single inner convex ball portion having a bore therethrough fixedly connected to said fixed shaft extending therethrough and an outer concave socket portion having an external surface fixedly connected to said inner surface of said cylindrical sleeve being positioned and balanced at a weighted center of said cylindrical sleeve being coaxially mounted around and spaced apart from said fixed shaft said cylindrical sleeve extending outwardly past said pivotal rotatable center bearing assembly;

at least one compressible bushing member disposed coaxially around said shaft and in cooperative communication with said inner surface of said cylindrical sleeve for absorbing shock due to deflections created by variations of the tension of the web of material passing thereover; and said cylindrical sleeve being deflectable by unequal tension of said web of material passing thereover and allowing for deflection and swiveling in an arc about said pivotal rotatable bearing assembly, whereby balancing of said cylindrical sleeve at the center thereof corrects deflections caused by the unequal tension in the conveyance of the web of material thereover.

22. The equalizer roll of claim 21, said fixed shaft limiting the deflection of said cylindrical sleeve.

23. The equalizer roll of claim 21, wherein the deflection of said cylindrical sleeve with respect to said shaft is in a range or from about 1 degree to about 15 degrees.

24. The equalizer roll of claim 21, wherein said cylindrical sleeve may be deflected with respect to said shaft in the range of from about one tenth of one degree to about 30 degrees.

25. The equalizer roll of claim 21, said equalizer roll being positioned before or after a roll having a web, ribbon, ream, sheet, or belt of material conveying therefrom in order to correct deflections and maintain a constant tension of the web of material being conveyed to prevent stretching and wrinkling, of for providing off rolling in a straight line preventing veer to one side.

26. The equalizer roll of claim 21, said cylindrical sleeve comprising material selected from the group consisting of steel, aluminum, copper, brass, teflon, graphite fiber, PVC, ABS, polyester, polyethylene, cellulose, fiberglass, and nylon.

27. The equalizer roll of claim 21, including means for removably retaining the pivotal center bearing assembly in position within said cylindrical sleeve.

28. The equalizer roll of claim 21, wherein said means for removably retaining the pivotal center bearing assembly in position within said cylindrical sleeve is a spacer.

29. The equalizer roll of claim 21, wherein said at least one compressible bushing member comprises an rotating inner bushing and a flexible outer bushing member.

30. The equalizer roll of claim 29, wherein said resiliency of said flexible outer bushing member is determined by at least two openings formed therein.

31. The equalizer roll of claim 29, said flexible outer bushing member cooperatively engaging said inner surface of said cylindrical sleeve by a friction fit.

32. The equalizer roll of claim 21, wherein said at least one compressible bushing member is inserted between said cylindrical sleeve and said shaft near the distal end of said cylindrical sleeve.

33. The equalizer roll of claim 29, wherein said inner bushing is composed of material selected from the group consisting of teflon, carbon graphite, nylon, or metal.

34. The equalizer roll of claim 29, wherein said inner bushing is composed of a self lubricating polymer.

35. The equalizer roll of claim 34, wherein said self lubricating polymer is teflon.

36. The equalizer roll of claim 29, wherein said flexible outer bushing member is composed of a flexible material selected from the group consisting of an elastomer, PVC, polyethylene, urethane, rubber, and silicon.

37. The equalizer roll of claim 29, wherein said flexible outer bushing member can withstand a temperature as high as 400° F. (204.4° C.).

38. The equalizer roll of claim 29, wherein said flexible outer bushing member has a durometer hardness in a range of from about A-45 to A-60.

39. The equalizer roll of claim 29, wherein said flexible outer bushing member comprises means for controlling the resiliency formed therein.

40. The equalizer roll of claim 39, wherein said resiliency of said flexible outer bushing member is determined by the thickness, radius, and curvature thereof.

* * * * *